US005158350A

United States Patent [19]

Sato

[11] Patent Number: 5,158,350

[45] Date of Patent: Oct. 27, 1992

[54] PROJECTION-TYPE VEHICULAR HEADLAMP

[75] Inventor: Masakazu Sato, Shizuoka, Japan

[73] Assignee: Koito Manufacturing Co., Ltd., Tokyo, Japan

[21] Appl. No.: 824,561

[22] Filed: Jan. 23, 1992

[30] Foreign Application Priority Data

Feb. 8, 1991 [JP] Japan ..... 3-17630

[51] Int. Cl.[5] ..... F21M 3/02

[52] U.S. Cl. ..... 362/61; 362/240; 362/332

[58] Field of Search ..... 362/61, 227, 240, 244, 362/309, 332

[56] References Cited

U.S. PATENT DOCUMENTS 4,631,642 12/1986 Brun .
4,670,818 6/1987 Moebius ..... 362/61
4,814,950 3/1989 Nakata ..... 362/332
4,839,785 6/1989 Ohishi ..... 362/61
4,895,693 1/1990 Suzuki et al. ..... 362/61
5,070,432 12/1991 Kitazumi et al. ..... 362/61

*Primary Examiner*—Richard R. Cole
*Attorney, Agent, or Firm*—Sughrue, Mion, Zinn, Macpeak & Seas

[57] ABSTRACT

A projection-type vehicular headlamp having a uniform appearance when viewed from the front. The inventive headlamp includes a lamp body, a front lens covering the lamp body and defining therebetween a lamp chamber, and a light projecting unit and a second lamp body provided in the lamp unit. In accordance with the invention, light distribution controlling steps are formed in a first pattern in a region of the front lens which confronts the second lamp body, and fine grooves which do not strong affect the light distribution of the light beam are formed in a second pattern in the region of the front lens which confronts the light projecting unit, with the first and second patterns being substantially equal to one another.

10 Claims, 3 Drawing Sheets

PROJECTION-TYPE VEHICULAR HEADLAMP

BACKGROUND OF THE INVENTION

The present invention relates to a projection-type vehicular headlamp with a headlamp body, namely, a light projecting unit in which the output light beam of a light source is reflected from a substantially ellipsoidal mirror and projected through a projecting lens. More particularly, the invention relates to a projection-type vehicular headlamp in which the light projecting unit and a second lamp body are accommodated integrally in a lamp chamber.

An example of a conventional headlamp of this type is a projection-type headlamp incorporating a clearance lamp which is constructed as shown in FIGS. 6 and 7. In this headlamp, a lamp body 1 and a front lens 2 define a lamp chamber, which accommodates a light projecting unit 3 and a second lamp unit such as a clearance lamp unit 6. The light projecting unit 3 is composed of a light source, namely, a light bulb 3*a*, a substantially ellipsoidal mirror 3*b*, and a projecting lens 3*c*. The light beam of the light bulb 3*a* reflected from the mirror 3*b* emerges from the projecting lens 3*c* as a substantially parallel light beam. The parallel light beam is projected from the lamp passing through a non-stepped region 2*a* of the front lens 2.

On the other hand, the clearance lamp body 6 includes a reflector 6*a* and a light source, namely, a light bulb 6*b* fitted in the reflector 6*a*. The output light beam of the bulb 6*b* advances as a direct light beam and a light beam reflected from the reflector 6*a*, thus being widely diffused in a horizontal direction by cylindrical diffusing steps 21*b* formed on the rear surface of the front lens 2. In FIG. 7, reference numeral 4 designates a cover coated with a surface light reflecting film. The cover 4 is arranged around the light projecting unit 3 so that the inside of the lamp chamber appears uniformly in a metallic color; that is, the provision of the cover 4 allows the lamp to be excellent in appearance when it is turned off.

In the above-described conventional headlamp, however, no cylindrical diffusing steps are formed in the part of the front lens 2 which confronts the light projecting unit 3; that is, the cylindrical diffusing steps are formed only in the part of the front lens 2 which confronts the clearance lamp body 6. Hence, as shown in FIG. 6, in the front lens 2, the part confronting the clearance lamp body and the part confronting the headlamp body are clearly distinguished in appearance from each other. This adversely affects the appearance of the lamp.

SUMMARY OF THE INVENTION

In view of the foregoing, an object of the invention is to provide a projection-type vehicular headlamp which has a good appearance when viewed from the front.

The foregoing and other objects of the invention have been achieved by the provision of a projection-type vehicular headlamp including a light projecting unit and a second lamp body including a light source provided in a lamp chamber defined by a lamp body and a front lens. The light projecting unit comprises a headlamp light source, a substantially ellipsoidal mirror for reflecting the output light beam of the headlamp light source forwardly, and a projecting lens arranged in front of the headlamp light source to convert the light beam reflected from the mirror into a substantially parallel light beam which advances forwardly. Light-distribution-controlling steps are formed in the region of the front lens which confronts the second lamp body. According to the invention, the region of the front lens which confronts the light projecting unit has a pattern formed with fine grooves which do not affect the light distribution with this pattern being substantially equal to the pattern of the steps formed in the region of the front lens which confronts the second lamp body.

Because the pattern of the fine grooves formed in the region of the front lens which confronts the light projecting unit is substantially equal to the patterns of the steps formed in the region of the front lens which confronts the second lamp body, the patterns formed on the front lens are substantially unified. That is, the right and left patterns on the front lens merge smoothly with each other in design.

Generally, the fine grooves perform no leasing function. However, in some cases, the grooves may partially perform as a lens for distributing light in the vertical and lateral directions of the vehicle.

DESCRIPTION OF THE PREFERRED EMBODIMENTS

Preferred embodiments of the invention will be o described with reference to the accompanying drawings.

Figure 1:
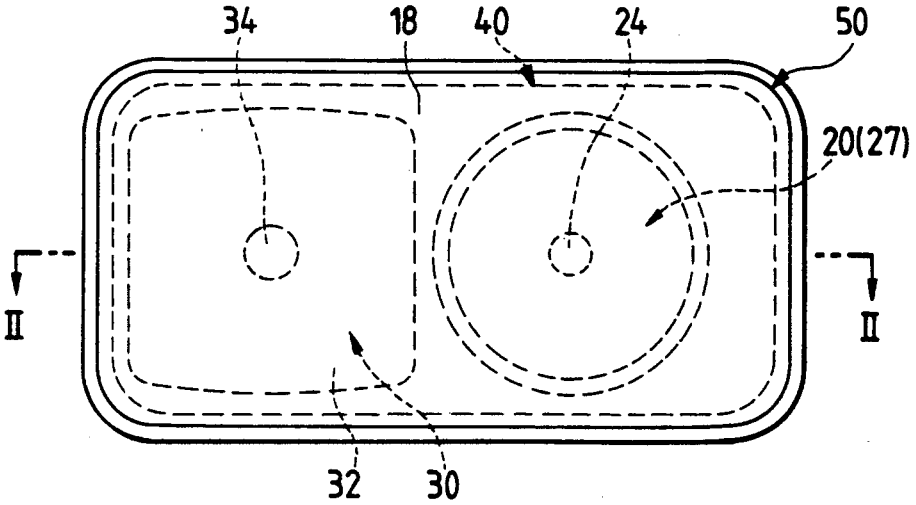
FIG. 1 is a front view of an example of a projection type vehicular headlamp constructed in accordance with a first embodiment of the invention.
Figure 2:
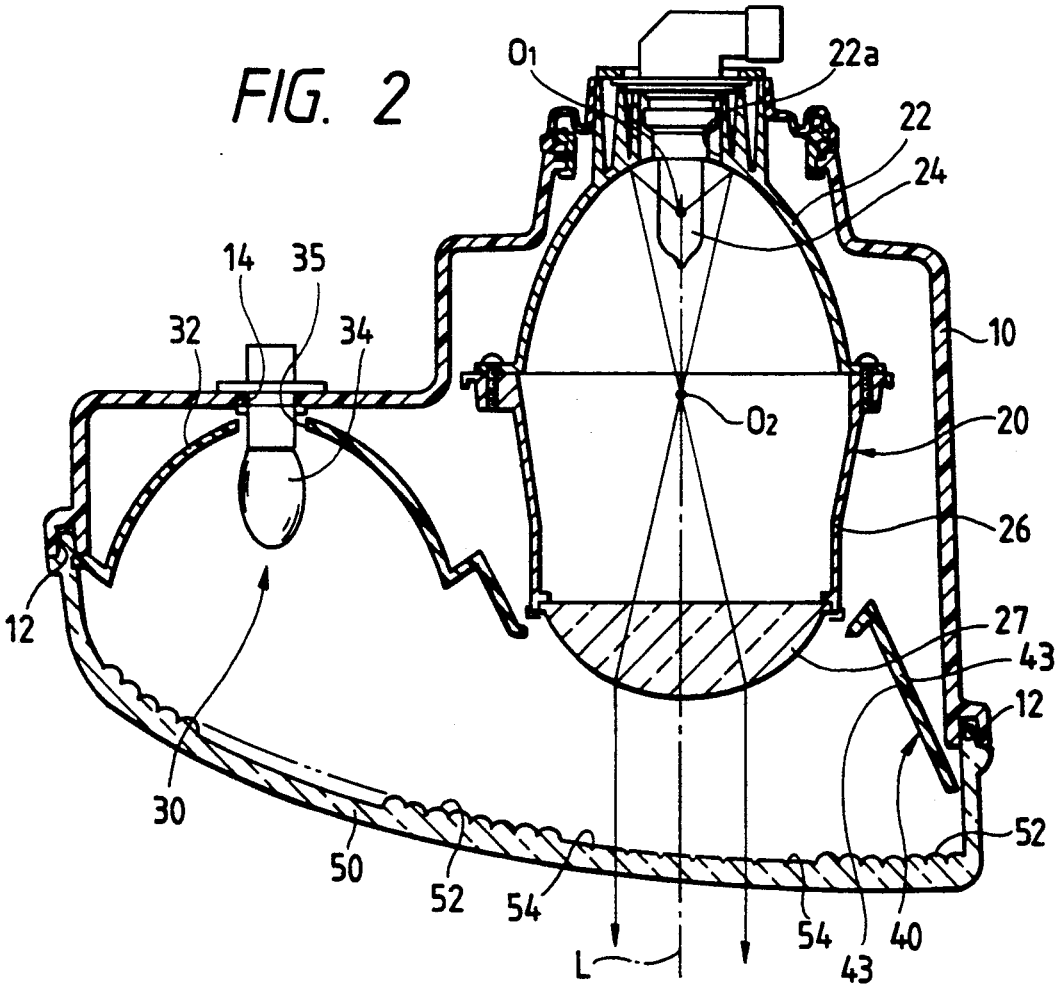
FIG. 2 is a horizontal sectional view of the headlamp taken along a line II—II in FIG. 1.
Figure 3:
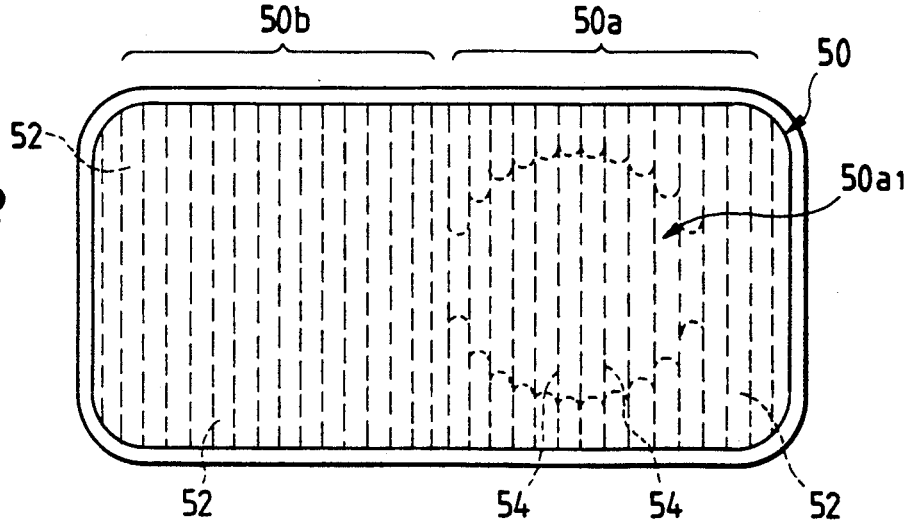
FIG. 3 is a front view of the front lens of the headlamp shown in FIGS. 1 and 2.

FIGS. 1 through 3 show an example of a projection-type vehicular headlamp incorporating a clearance lamp, and which is constructed in accordance with a first embodiment of the invention. More specifically, FIG. 1 is a front view of the headlamp according to the invention, FIG. 2 is a horizontal sectional view of the headlamp shown in FIG. 1 taken along the line II—II in FIG. 1, and FIG. 3 is a front view of the front lens of the headlamp.

In FIGS. 1 through 3, reference numeral 10 designates a lamp body in the shape of a container which is rectangular and elongated horizontally when viewed from the front. The lamp body has a seal groove 12 in the edge of the rectangular front opening. The leg of a front lens 50 is fitted in the seal groove 12 through a sealing agent. Thus, the front lens 50 and the lamp body 10 form a lamp chamber. A headlamp body, namely, a light projecting unit 20, and a second lamp body, namely, a clearance lamp body 30, are provided in the lamp body 10 side by side, thus forming a headlamp.

The light projecting unit 20 includes a substantially ellipsoidal mirror 22 with a bulb inserting hole 22*a* formed in the rear end portion, a light source, namely, a light bulb 24 fitted in the bulb inserting hole 22*a*, a projecting lens 27 connected through a lens holder 26 to the mirror 22. The light projecting unit 20 is supported by aiming mechanisms (not shown). The filament of the light bulb 24 is located near the first focal point $O_1$ of the mirror 22. The light beam of the light bulb 24 reflected from the mirror 22 advances forwardly through the second focal point $O_2$ of the mirror 22, and is formed into a substantially parallel light beam by the projecting lens 27. The parallel light beam thus formed is projected from the lamp passing through the front lens 50 (see FIG. 2). In FIG. 2, reference character L designates the optical axis of the headlamp, which can be adjusted in position by tilting the light projecting unit 20 with the aiming mechanisms.

A cover 40 is arranged around the light projecting unit 20 in such a manner that it surrounds the projecting lens 27 forming the front end portion of the light projecting unit. The cover 40 extends laterally, thus forming a reflector 32 for the clearance lamp body 30. That is, the cover 40 and the reflector 32 are formed as one unit using a synthetic resin. A mirror surface 43 is formed on the entire front surface of the cover 40 including the reflector 32 by vacuum-depositing aluminum or by plating with chromium. The cover 40 is fixedly arranged between the front lens 50 and the lamp body 10. More specifically, the cover 40 is connected to the lamp body 10 and the front lens 50 by lance engagement Or with screws, or it may be clamped between the lamp body 10 and the front lens 50.

The clearance lamp body 30 includes the aforementioned reflector 31, which is integral with the cover 40 and provides a paraboloidal surface, and a light source, namely, a light bulb 34, which is fixedly fitted in a bulb inserting hole 14 formed in the lamp body 10 and protrudes forwardly through a bulb inserting hole 35 formed in the rear end portion of the reflector 32.

The light bulb 34 emits a light beam. A part of the light beam thus emitted advances forwardly directly, and a part of it is reflected by the reflector 32 before advancing forwardly. The light beam thus advanced forwardly is diffused horizontally by vertically elongated cylindrical diffusing steps 51 formed side by side on the rear surface of the region 50*b* (see FIG. 3) of the front lens 50 which confronts the clearance lamp body 30.

The same diffusing steps 52 are formed in the righthalf region 50*a* of the front lens 50, except for a circular region 50*a* which confronts the light projecting unit 20. In the circular region $50a_1$, fine vertical grooves 54 triangular in section are formed at the same intervals as the diffusing steps 52. That is, the border lines between the adjacent steps 52, and the fine grooves 54 are in alignment with one another, thus forming a continuous pattern. Hence, when the front lens 50 is viewed from the front, a vertical stripe pattern is observed, that is, a series of vertical stripes can be seen over the entire surface of the front lens. The light beam emitted from the projecting lens 27 of the light projecting unit 20 passes through the circular region $50a_1$, thus forming a predetermined light distribution pattern. The width of each of the vertical grooves 54 is determined so that the vertical grooves 54 will not adversely affect the desired light distribution pattern.

Figure 4:
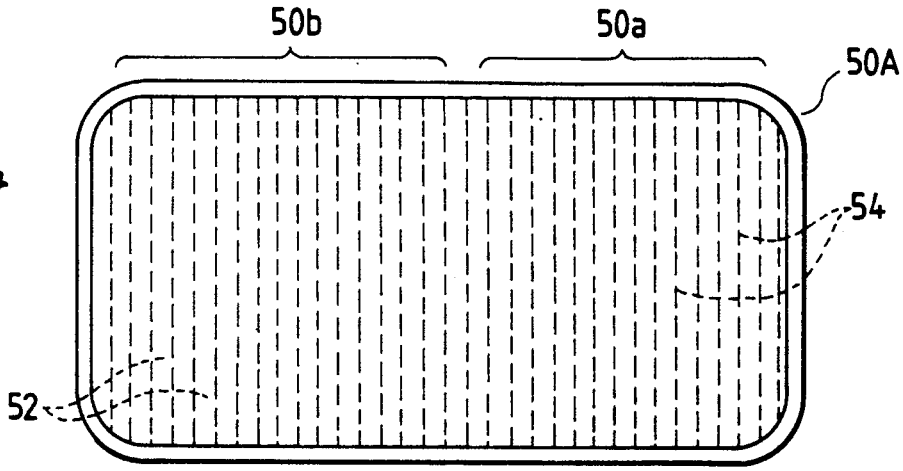
FIG. 4 is a front view of a front lens which is an constructed according to a second embodiment of the invention.

FIG. 4 is a front view of a front lens constructed according to a second embodiment of the invention.

The second embodiment has the same internal arrangement as the above-described first embodiment, except for the regions of the front lens where diffusing steps 52 and fine vertical grooves 54 are formed.

More specifically, in the second embodiment, the diffusing steps 52 are formed side by side on the rear surface of the left half region 50*b* of the front lens which confronts the clearance lamp body, and the fine vertical grooves 54 equal in width to the diffusion steps 52 are formed side by side on the rear surface of the right half region 50*a* of the front lens, including the circular region confronting the light projecting unit.

In the first embodiment the diffusing steps 52 are formed over the whole region of the front lens 50 except for the circular region 50*a* confronting the light projecting unit 20, and therefore the boundary between the region where the steps 52 are formed and the region where no steps are formed appears circular (see FIG. 3). On the other hand, the second embodiment has no such a boundary.

Figure 5:
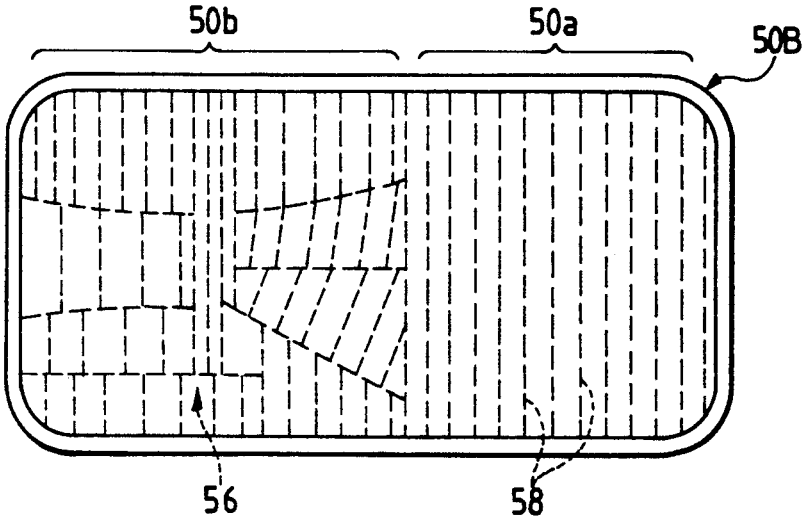
FIG. 5 is a front view of a front lens which is an essential components of a projection-type vehicular headlamp constructed according to a third embodiment of the invention.
Figure 6:
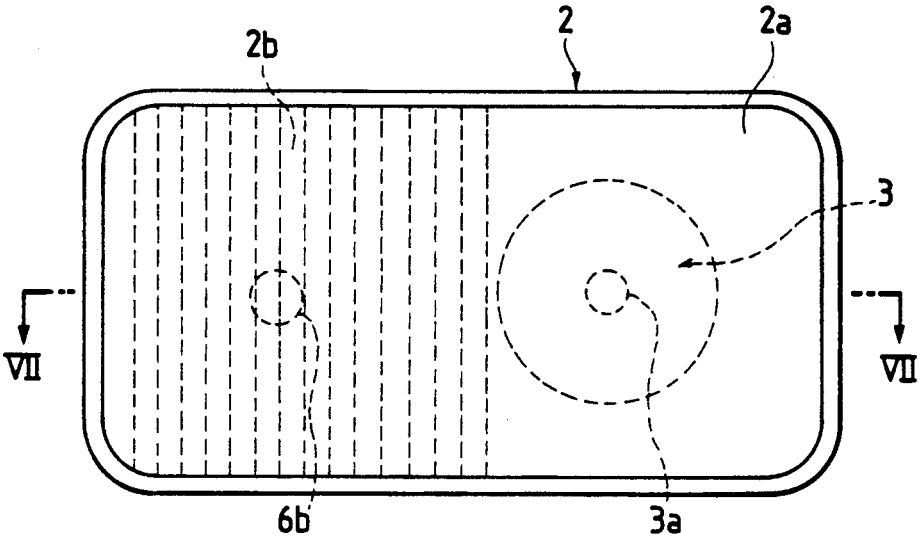
FIG. 6 PRIOR ART
FIG. 6 is a front view of a conventional headlamp.
Figure 7:
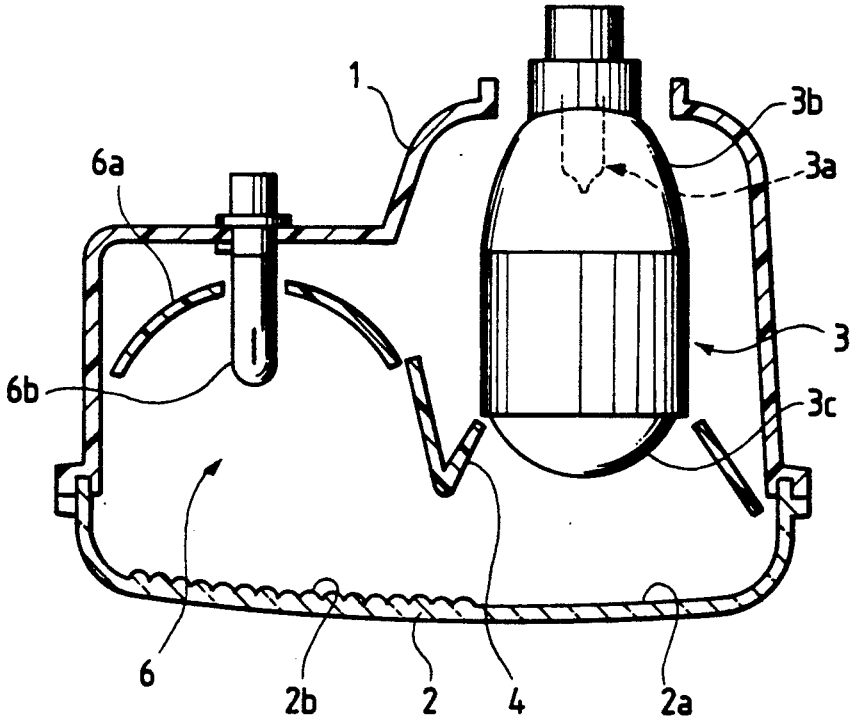
FIG. 7 PRIOR ART
FIG. 7 is a horizontal sectional view of the conventional headlamp taken along a line VII—VII in FIG. 6.

FIG. 5 is a front view of a front lens 50B which is intended for use with four-lamp type vehicular headlamp and which is constructed in accordance with a third embodiment of the invention.

In the third embodiment, a second lamp body, namely, a main-beam-forming reflection-type headlamp body (not shown) including a paraboloidal mirror and a light bulb is mounted in the lamp body in such a manner that it is located adjacent a first lamp body, namely, a sub-beam forming light projecting unit. Steps 56 are formed on the rear surface of the left half region 50*b* of the front lens 50B which confronts the reflection-type headlamp body so as to control the direction of the light beam emerging from the front lens, i.e., the direction of emergence of the parallel light beam reflected from the paraboloidal mirror of the reflection-type headlamp body. In addition, fine vertical grooves 58, which are substantially equal in width to the steps 56, are formed side by side on the rear surface of the right half region of the front lens (which confronts the sub-beam forming light projecting unit) where no steps 56 are formed.

In the above-described first through third embodiments of the invention, the clearance lamp body or the main-beam-forming reflection-type headlamp body is mounted adjacent the light projecting unit 20 in the lamp body 10; however, it should be noted that the invention is not limited thereto or thereby. That is, the second lamp body built in the lamp body together with the light projecting unit may be a turn signal lamp body or other type of lamp. Instead of the above described reflection-type lamp body, a non-reflection type lamp body may be employed as the second lamp body in which the light beam is controlled in the direction of emergence with prism steps formed on the rear surface of the front lens.

In the general case, the grooves perform no leasing function. However, if desired, the grooves may be shaped so as to perform a partial lens function for distributing light in the vertical and lateral directions of the vehicle.

As is apparent from the above description, in the projection-type vehicular headlamp of the invention, the pattern of fine grooves formed on the region of the front lens which confronts the light projecting unit and the patterns of the steps formed on the region of the front lens which confronts the second lamp body are substantially unified; that is, the right and left patterns on the front lens merge smoothly with each other in design. Thus, the resultant headlamp is excellent in external appearance.

What is claimed is:

1. A projection-type vehicular headlamp comprising:

a first lamp body;

a front lens covering a front opening of said first lamp body and defining therebetween a lamp chamber;

a light projecting unit comprising a headlamp light source, a substantially ellipsoidal mirror for reflecting an output light beam of said headlamp light source forwardly, and a projecting lens arranged in front of said headlamp light source to convert said output light beam reflected from said mirror into a substantially parallel light beam which projects forwardly; and a second lamp body having a light source, said light projecting unit and said second lamp body being mounted in said lamp chamber defined by said first lamp body and said front lens, wherein:

light distribution controlling steps are formed in a first pattern in a region of said front lens which confronts said second lamp body, and fine grooves which do not strongly affect light distribution of said parallel light beam are formed in a second pattern in a region of said front lens which confronts said light projecting unit, said first and second patterns appearing substantially equal to one another when viewed from in front of said headlamp.

2. The projection-type vehicular headlamp of claim 1, wherein said fine grooves are triangular in section.

3. The projection-type vehicular headlamp of claim 1, wherein said steps of said first pattern and said fine grooves of said second pattern are arranged as parallel lines at equal intervals within said first and second patterns.

4. The projection-type vehicular headlamp of claim 3, wherein bordering lines of said first and second patterns are in alignment with one another to form a continuation between said first and second patterns.

5. The projection-type vehicular headlamp of claim 3, wherein said lines are substantially straight and extend in a vertical direction.

6. The projection-type vehicular headlamp of claim 1, wherein said steps are formed over substantially an of said front lens except for a circular region confronting said light projecting unit.

7. The projection-type vehicular headlamp of claim 1, wherein said steps are formed side by side on a rear surface of one of right and left half regions of said front lens, and said fine grooves are formed side by side on a rear surface of the other of said right and left half regions of said front lens.

8. The projection-type vehicular headlamp of claim 1, wherein said second lamp body comprises a clearance lamp body.

9. The projection-type vehicular headlamp of claim 1, wherein said second lamp body comprises a main-beam-forming reflection-type headlamp body.

10. The projection-type vehicular headlamp of claim 1, wherein said second lamp body comprises a turn signal lamp body.

* * * * *